United States Patent [19]

Brown

[11] 4,324,538

[45] Apr. 13, 1982

[54] ROTARY POSITIVE DISPLACEMENT MACHINE WITH SPECIFIC LOBED ROTOR PROFILES

[75] Inventor: Arthur E. Brown, Lake George, N.Y.

[73] Assignee: Ingersoll-Rand Company, Woodcliff Lake, N.J.

[21] Appl. No.: 139,224

[22] Filed: Apr. 11, 1980

Related U.S. Application Data

[63] Continuation-in-part of Ser. No. 946,320, Sep. 27, 1978, Pat. No. 4,224,016.

[51] Int. Cl.[3] ..... F01C 1/20; F04C 18/20

[52] U.S. Cl. ..... 418/191

[58] Field of Search ..... 418/191

[56] References Cited

U.S. PATENT DOCUMENTS

| | | | |
|---|---|---|---|
| 67,978 | 8/1867 | Hanford | 418/191 |
| 92,842 | 7/1869 | Knapp | 418/191 |
| 1,052,124 | 2/1913 | Berger | 418/191 |
| 3,472,445 | 10/1969 | Brown | 418/191 |
| 3,535,060 | 10/1970 | Brown | 418/191 |
| 3,894,822 | 7/1975 | Abaidullin et al. | 418/191 |

FOREIGN PATENT DOCUMENTS

| | | | |
|---|---|---|---|
| 661120 | 5/1979 | U.S.S.R. | 418/191 |

*Primary Examiner*—John J. Vrablik

*Attorney, Agent, or Firm*—Bernard J. Murphy; David W. Tibbott

[57] ABSTRACT

A rotary compressor, expansion engine, or the like. Two interengaging rotors rotate in a casing structure. The optimum number of lobes per rotor is two for pressure ratios up to about three. The first rotor has end plates thereon which open and close larger ports in the end walls. Low pressure dump pockets are formed twice per rotation and these have now been determined to have negligable loss. The first rotor has lobes of small angle so as to reduce a precompression loss. The second rotor has lobes of larger angle so as to improve performance. An interchamber throttling loss has now been reduced. When operating as a compressor machine, the discharge ports start to be uncovered about 15 degrees early for better performance.

5 Claims, 14 Drawing Figures

ROTARY POSITIVE DISPLACEMENT MACHINE WITH SPECIFIC LOBED ROTOR PROFILES

This application is a continuation-in-part of co-pending application Ser. No. 946,320 filed Sept. 27, 1978, now U.S. Pat. No. 4,224,016, issued Sept. 23, 1980.

DISCUSSION OF PRIOR ART

The main feature of my earlier U.S. Pat. No. 3,472,445 was that it taught how to profile the rotors and shape the discharge ports 17 so as to obtain zero (or near zero) clearance volume—thereby delivering to the discharge ports all the air compressed (except leakage) and thus no high pressure air was wasted. In FIG. XX of U.S. Pat. No. 3,472,445 were shown double lobed rotors said to have "disadvantages" in the description thereof. Those FIG. XX rotors were identical (to save cost). I have since determined that it is advantageous to instead make the rotors dissimilar (in specific ways) so as to improve performance as described herein.

My earlier U.S. Pat. No. 3,535,060 shows rotors with end plates 9. Again, that patent also showed single lobe rotors as the preferred species because at that time, I considered single lobe rotors to be superior to double lobe rotors.

Unlike double lobe rotors, single lobe rotors do not have a precompression problem nor do they have dump pockets as are shown at 16 in the present application.

The present invention comes to grips with the problems of precompression and dump pockets so as to secure the advantages (but not the drawbacks) of double lobe rotors.

Referring again to U.S. Pat. No. 3,535,060, the machine shown therein had an interchamber throttling problem now illustrated in FIG. 4 (prior art) of the present application. This problem has now been eliminated as shown in FIG. 9 herein.

Referring again to U.S. Pat. No. 3,535,060; in column 6 lines 14 to 19, the basic idea of early port opening (as a compressor) was mentioned. The present application is more specific regarding such early port opening.

OBJECTS AND ADVANTAGES OF THIS INVENTION

1. The first object (not new) is to obtain maximum area of the ports 14. This objective is made possible by means of the end plates 10 which open and close the larger ports.

2. Larger port area (per object 1) permits higher R.P.M. for a given width of rotor.

3. Higher R.P.M. (per object 2) increases the capacity output for a given size machine.

4. Higher capacity output (per object 3) reduces the percent leakage and thereby improves efficiency.

5. Another object is to provide an operating pressure ratio as high as three per stage. Thus in a two stage air compressor, the output pressure of the second stage can be $14.7 \times 3 \times 3 = 132$ P.S.I.A. or 118 P.S.I.G.

6. Another object of this invention is to form a logical decision as to the optimum number of lobes per rotor for this type of rotary machine, i.e. Should there be one, two, three, or four lobes per rotor? Should one rotor have more lobes than the other rotor and if so which one? It has been determined that the optimum combination is to use exactly two lobes per rotor as will be explained in careful detail.

7. Another object is to effectively eliminate a precompression problem associated with double lobe rotors. This objective is secured by providing narrow angle pointed lobes 25 on the port controlling first rotor.

8. Another object is to improve performance two ways through the use of wide angle lobes 6 on the second rotor. These two ways (a and b) are subsequently described in detail.

9. Another object is to reduce an interchamber throttling loss as shown at c in FIG. 4 (prior art). This objective is now obtained by: (1) using two lobes per rotor (instead of single lobe rotors) and by (2) rounding off the corner 32 of the hub as now shown at *7a* in FIG. 9.

10. An unexpected result in this invention is that the dump pockets 16 in FIG. 7 are not a problem. In fact, the power loss therefrom is calculated to be less than one tenth of one percent of the adiabatic work of compression as will be explained.

11. Another object of this invention is to use two lobes per rotor (instead of single lobe rotors) and at the same time secure zero (or near zero) clearance volume such that when operating as a compressor, all the high pressure compressed air (except leakage) is delivered to the discharge ports and none is throttled (wasted) back to inlet pressure. The dump pockets 16 are not now regarded as clearance volumes since the dump pockets are formed at the low pressure end of the rotary cycle and their low loss is as described. The present invention secures zero (or near zero) clearance volume at the high pressure end of the rotor cycle by shaping the ports 14 and rotor lobes as taught in U.S. Pat. No. 3,472,445.

12. Another object of this invention is to improve performance (as a compressor) by starting to uncover the higher pressure (discharge) ports 14 prior to the time when internal chamber pressure reaches full discharge line pressure. This basic principle was briefly mentioned in said prior art so that the improvement herein is limited to specific details.

BRIEF DESCRIPTIONS OF THE DRAWINGS

FIGS. 1, 2, and 3 are line drawings illustrative of prior art rotors and casings (with the rotors in elevation and the casings in section) in successive, compressor-function rotative positions. These 3 figures depict the unwarranted precompression and subsequent internal throttling loss encountered with such prior art construction.

FIG. 5 illustrates the start of compression in chamber 24 and the last phase of delivery in front of lobe 5.

FIG. 6 shows the very early release of precompression so as to avoid the precompression problem associated with FIGS. 1 to 3.

FIG. 7 shows the rotor positions at the instant the dump pockets 16 are formed.

FIG. 8 shows the rotor positions after substantial internal compression has taken place and just prior to the delivery portion of the rotary cycle.

FIG. 9 shows the rotor positions after opening of the two higher pressure (discharge) ports 14 and during the delivery portion of the rotary cycle. FIG. 9 illustrates how the interchamber throttling loss problem of FIG. 4 is now reduced.

FIGS. 4 to 9 are all section views with the sections taken perpendicular to the axes of the rotors and midway along the width of the rotors.

In FIG. 11 the rotors have been removed so as to more clearly show one of the higher pressure ports 14 and its angular extent F for a pressure ratio of three in a machine having two lobes per rotor.

DETAILED DESCRIPTION OF THIS INVENTION—FIGS. 5 TO 10

Each rotor has a main cross section profile (shown sectional in FIGS. 5 to 9) which extends along the major width of each rotor. Each rotor also has a different thinner cross section profile (shown sectioned in FIG. 10) located at each axial end of the rotors. The two end profiles of the first rotor 1 are identical. The two end profiles of the second rotor 2 are identical.

Figure 5:
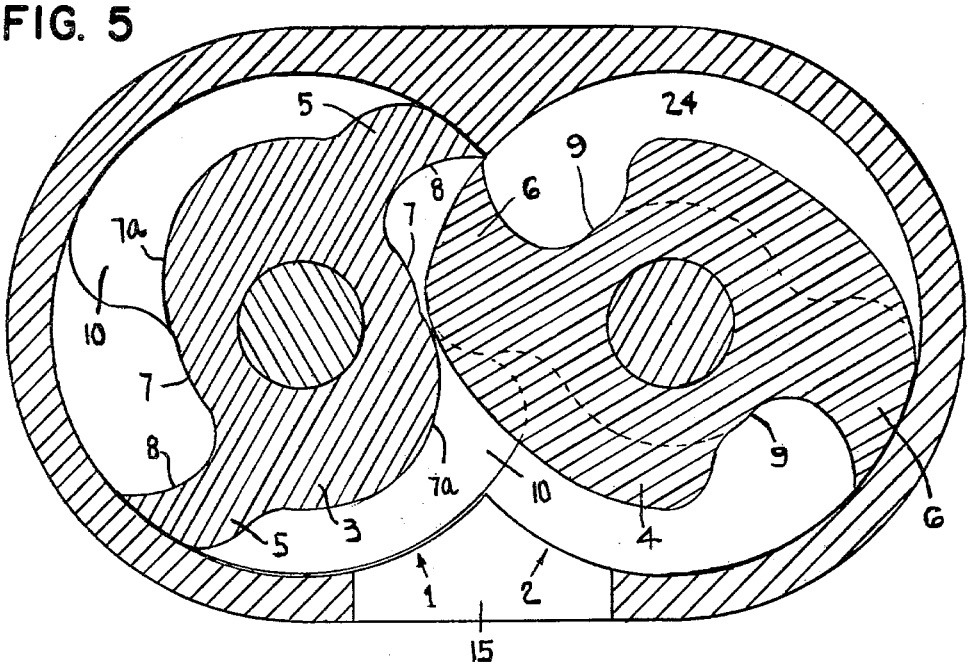

Referring now to the main profiles of both rotors as seen in FIG. 5: The first rotor 1 and the second rotor 2 each have a main hub 3 and 4 mounted on rotor shafts. Main lobes 5 and 6 are attached to their respective main hubs. The first rotor main hub 3 has small radius profiles at 7 which are located angularly adjacent the concave faces 8 of a respective main lobe 5. The second rotor main hub 4 also has small radius profiles at 9 which are also referred to as the grooves 9.

Figure 10:
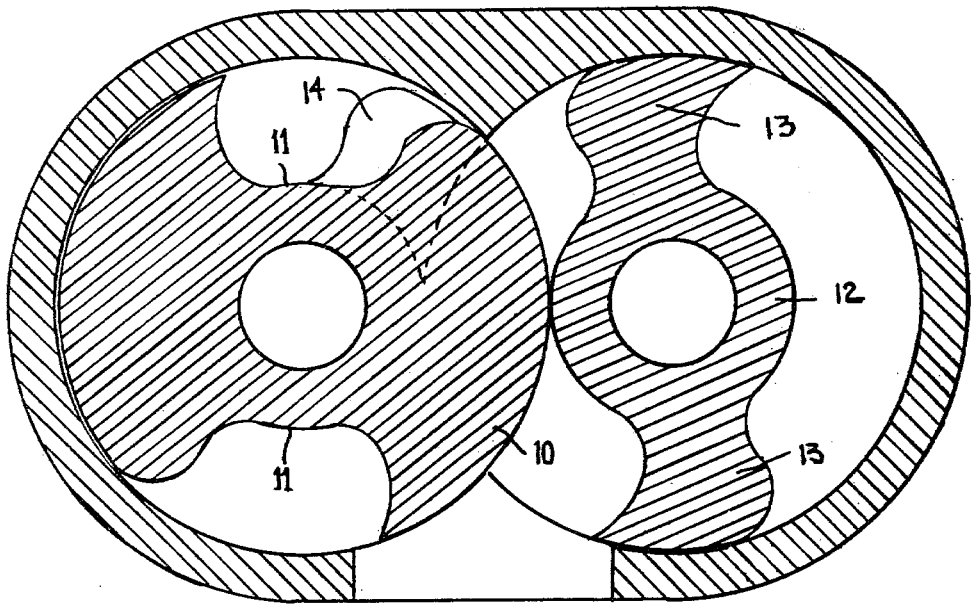
FIG. 10 is a section view of the same machine shown in FIG. 9 but the section is taken near the end of the rotor.
Figure 12:
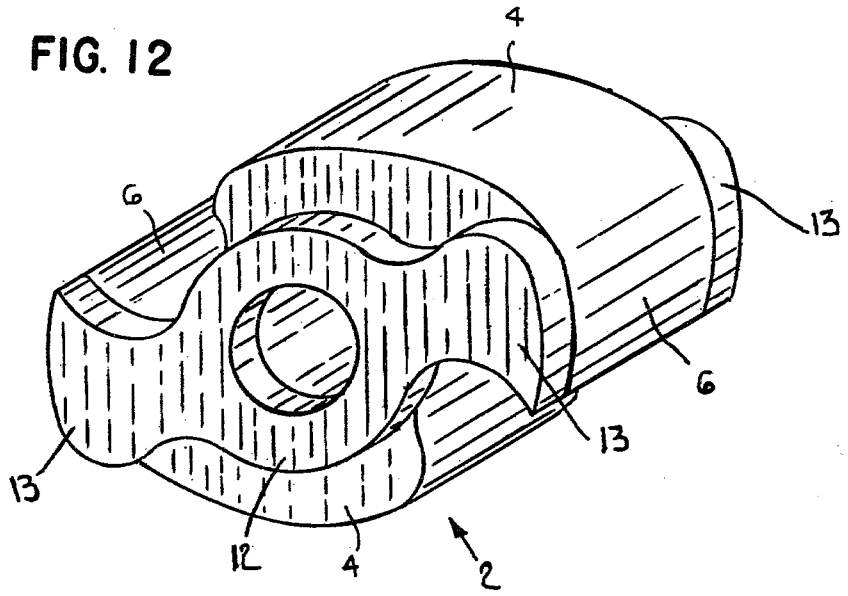
FIGS. 12 and 13 are isometric views of the same rotors used in FIGS. 5 to 10.
Figure 13:
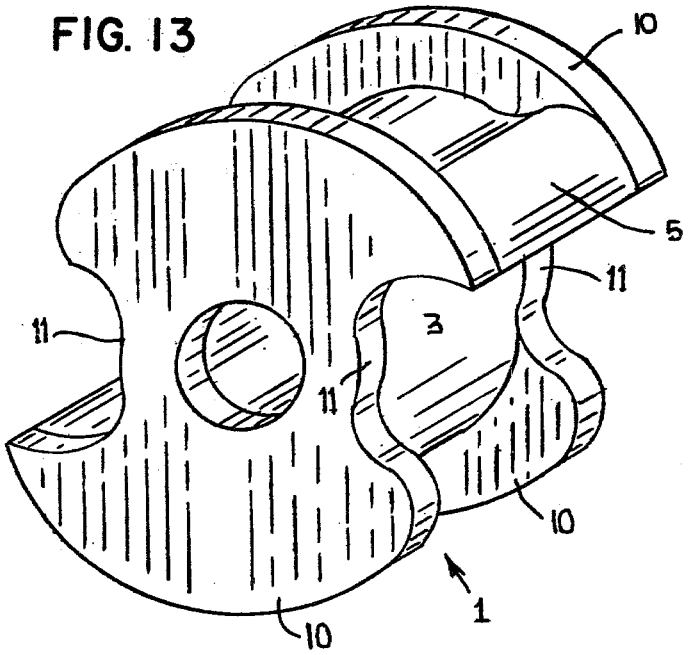

Referring now to the end sections of both rotors as shown in FIGS. 10, 12, and 13. A flat end plate 10 is located at each end of the first rotor 1. The end plates could be either separate pieces of metal (held to the main body of the rotor with bolts or rivets) or they could be formed integral with the main body of the rotor by means of a milling operation. The grooves 11 pass through the end plates.

Each end section of the second rotor 2 contains a smaller hub 12 and two end lobes 13 attached thereto. Each small hub 12 rotates in sealing relation with the outer radius of a respective end plate 10. Each end lobe 13 interengages with a respective groove 11 in the end plate. Again, each end section of the second rotor could be a separate piece attached to the main body of the rotor or it could be an integral part thereof.

Figure 11:
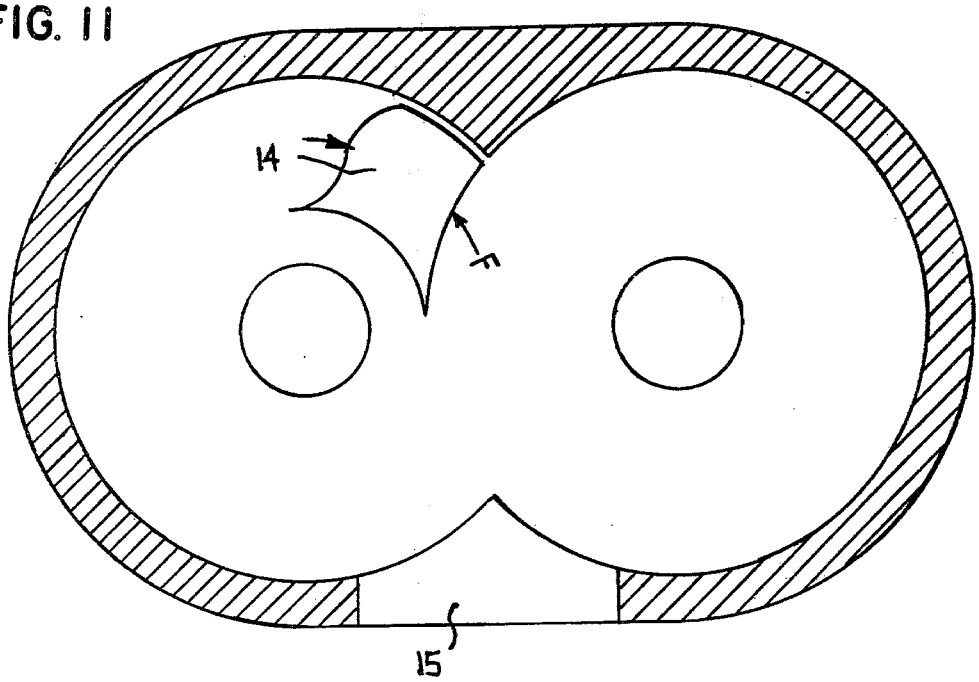
FIG. 11 is a section view of the same casing used in FIGS. 5 to 10.

FIG. 11 shows one (of two) of the higher pressure ports 14 located one in each end wall of the bore containing the first rotor. The two ports 14 are to be interconnected with a manifold (not shown) to a common outlet (as a compressor) or inlet (as an engine).

In FIG. 11, when operating as a compressor machine, the lower pressure port 15 is the inlet port and the higher pressure ports 14 are the discharge ports. When operating as an expansion engine, the higher pressure ports 14 become the inlet port and the lower pressure port 15 becomes the outlet port.

Those advantages obtained as a compressor (as described herein) are also obtained (in a reverse fashion) as an expansion engine.

During a rotative cycle, the higher pressure ports 14 are alternately covered and uncovered by the end plates 10 and their grooves 11 so as to control the flow of the working fluid (air, gas, vapor, etc.) through the higher pressure ports 14 and thereby obtain either internal compression (as a compressor machine) or internal expansion (as an expansion engine).

A feature of the end plates 10 is that they permit the outer radius of the ports 14 to extend (less lap) to the outer radius of the rotor and thereby the area of the ports is greatly increased.

For higher pressure ratios, retain the same main profiles but make the grooves 11 smaller in angle, the end lobes 13 smaller in angle, and the ports 14 smaller in angle F.

THE OPTIMUM NUMBER OF LOBES PER ROTOR IS EXACTLY TWO—FOR THE FOLLOWING REASONS:

1. Double lobe rotors have a net cubic displacement per rotation which is 18% more than for single lobe rotors. This is because single lobe rotors have about a 90 degree dwell period during which no displacement occurs as can be seen in FIGS. IV and V of U.S. Pat. No. 3,472,445. More displacement per rotation is a very desirable feature since it increases capacity and reduces percent leakage; and therefore double lobe rotors are (for this reason) preferable over single lobe rotors.

2. Double lobe rotors are easier to balance than single lobe rotors and there is no need to provide hollow spaces inside the rotors in order to achieve balance. Thus, the rotors can be made of solid plate stock instead of hollow castings and are thus stronger, simpler, and less expensive even though more profiling is required.

3. In a compressor machine having double lobe rotors, the flow of air or gas through the lower pressure (inlet) port 15 is continuous.

With single lobe rotors, there is a dwell period (of about 90 degrees duration) during which displacement does not take place. Such a dwell period causes the flow of air through the inlet port to have a start-stop-start-stop flow pattern which is disadvantageous from the standpoints of noise, capacity, and efficiency.

Figure 7:
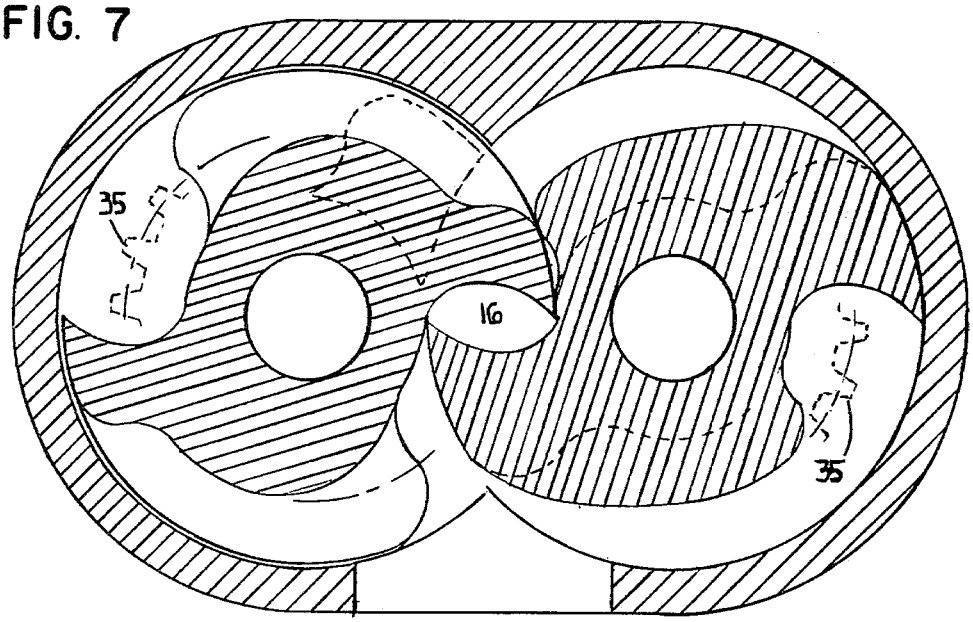

4. Single lobe rotors do not have dump pockets wherein pressurized gas is dumped. However, double lobe rotors do have the dump pockets 16 (FIG. 7). A fortunate and unexpected feature of this invention is that the calculated loss in efficiency of the machine due to dump pockets 16 is less than one tenth of one percent—as will be explained.

Figure 1:
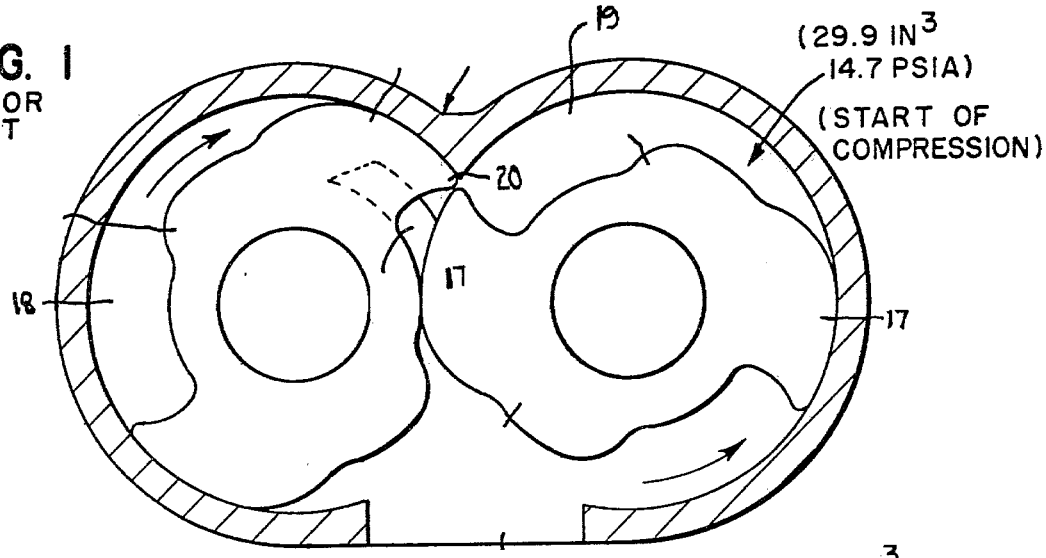
FIG. 1 PRIOR ART
Figure 2:
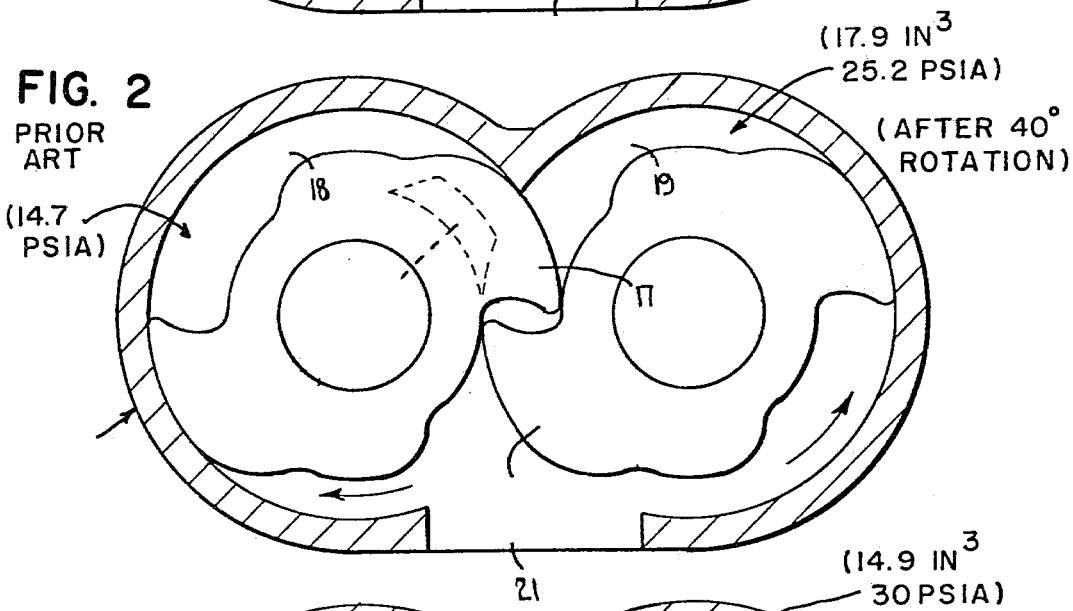
FIG. 2 PRIOR ART
Figure 3:
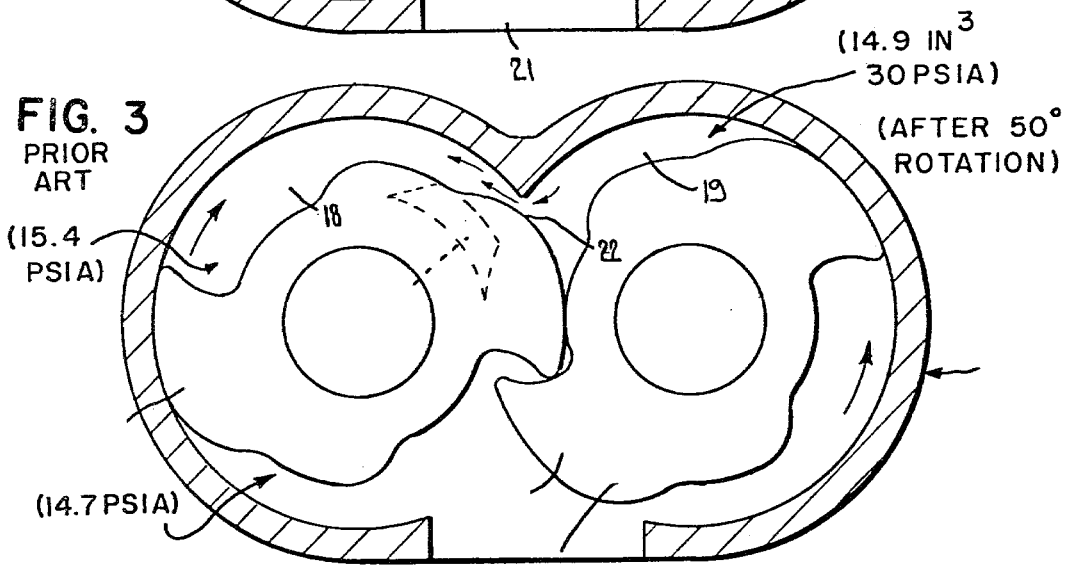
FIG. 3 PRIOR ART

5. Single lobe rotors do not have a precompression problem; however, (prior to this invention) double lobe rotors did have a precompression problem as illustrated in FIGS. 1 to 3 (prior art) herein. The precompression problem associated with double lobe rotors has now been eliminated.

6. As listed in item 1 previous, double lobe rotors have 18% more displacement than single lobe rotors. There is no point, however, in going to three lobes or four lobes per rotor as this would gain nothing further in displacement since said dwell period is eliminated in going from one lobe per rotor to two lobes per rotor. In fact, three or four lobe rotors would have less displacement than two lobe rotors on account of more metal (and less air or gas) in the addendum band. The addendum band is located outside the pitch circle of a rotor (as per gear and rotor terminology).

7. If three lobes per rotor (instead of two lobes per rotor) were employed, then each lobe (of the first rotor) would have less angular distance to travel before uncovering the higher pressure (discharge) port 14. This means therefore, that for a given built-in pressure ratio the angular extent F (in FIG. 11) of the higher pressure ports 14, would be less for a three lobe first rotor than for a two lobe first rotor. To carry this line of reasoning a step further; assume a four lobe first rotor and a pressure ratio of three. Under these circumstances, the angular extent F of the port becomes so small that the port becomes almost non-existent.

Thus a two lobe first rotor would have more port area than a three lobe first rotor. More port area means less throttling loss of air flowing through the ports 14.

To carry the above line of reasoning one step in the opposite direction, a single lobe rotor would have more port area (for a given built-in pressure ratio) than a double lobe rotor and for the same reason (more angle of travel prior to opening the port). However, for an operating pressure ratio of up to three, the use of double lobe rotors has been found quite satisfactory under both calculation and test.

For much higher pressure ratios, (say 8 to 1 in a single stage) single lobe rotors would be preferable.

8. A double lobe rotor is less expensive to fabricate than would be a three lobe rotor. Also, it would be easier to time with the timing gears.

DISCUSSION OF PRECOMPRESSION PROBLEM ENCOUNTERED WITH FIGS. 1 TO 3 (PRIOR ART)

In FIG. 1, both rotors have wide angle lobes 17 similar to that of 6 in FIG. 5. In such a machine and when operating as a compressor, the pressure in chambers 18 and 19 is still at or near inlet pressure. The leading tip 20 of lobe 17 is just beginning to enter chamber 19 and this is the start of "precompression" (an undesirable effect). FIG. 2 shows the rotor positions after forty degrees of rotation from their FIG. 1 positions. As can be seen in FIG. 2, the lobe 17 has projected into chamber 19 reducing the chamber volume from 29.9 cubic inches to 17.9 cubic inches and thus causing a precompression in chamber 19 (an undesirable effect). With the proportions as drawn, neglecting leakage, and assuming atmospheric inlet pressures at port 21, and chamber 18, the pressure in chamber 19 (at the FIG. 2 rotor positions) is calculated to be 25.2 PSIA (or 10.5 PSIG above atmospheric).

FIG. 3 illustrates the rotor positions after fifty degrees of rotation from the FIG. 1 positions. A throttling loss occurs at 22 as the precompressed air in chamber 19 throttles into chamber 18. It is an object of this invention to prevent such loss in a simple manner, as explained in the description of FIGS. 5 and 6.

FIGS. 5 AND 6 ELIMINATE THE PRECOMPRESSION PROBLEM

The port controlling rotor 1 is referred to as the first rotor; and the coacting rotor 2 is referred to as the second rotor. The first rotor 1 is provided with smaller angle lobes 5 which have an angle of arc "A" of about 15 degrees as shown. With such an arrangement, the precompression effect is much less. With the proportions as drawn, neglecting leakage, and assuming atmospheric inlet pressure at port 15 and chamber 23 the pressure in chamber 24 (at the FIG. 6 rotor positions) is calculated to be 16.7 P.S.I.A. or 2 P.S.I.G. above atmospheric. Thus, the effect of precompression (and subsequent throttling of same) is greatly reduced. The lobes 5 have pointed ends 25 as opposed to a fat bulbous end) and this means the pointed ends 25 can project substantially into chamber 24 without substantially raising the "precompression" pressure. This is because the pointed ends occupy low volume.

CONCERNING THE SECOND ROTOR LOBES

From the standpoint of compression efficiency (and assuming a pressure ratio of three of less), the second rotor 2 should have lobes 6 with a larger included angle than that of the first rotor. There are two reasons for this (a and b as follows):

(a) In a rotary compressor, the uncovered area of the higher pressure ports 14 becomes less and less as the lobes approach the end of each delivery phase (see the rotor positions shown in FIG. 5). If the second rotor 2 is provided with a lobe 6 having a thirty degree (or larger) angle of arc B (FIG. 6), then it can finish its portion of the delivery phase of the cycle (as shown in FIG. 5) prior to the completion of the first rotor lobe delivery. Result: there is less pressure drop through the discharge ports 14 during the last phase of each delivery portion of the cycle.

(b) A large angle of arc B (for lobes 6) has a longer leak path for the leakage of air past the lobes.

Thus, this invention teaches the concept of making each pair of rotors dissimilar with the port controlling first rotor having narrow angle lobes (to eliminate precompression) and the coacting second rotor having wider angle lobes (to improve performance).

DUMP POCKETS—FIG. 7

Dump pockets 16 are formed twice per rotation and they are bounded by the concave faces of the rotor lobes and the casing end walls. When operating as a compressor, the dump pockets 16 are formed shortly after the start of compression and therefore the gas in the dump pockets 16 is only slightly pressurized. In about the next five degrees of rotor rotation this low pressure gas is dumped back to inlet pressure. In the first stage of an air compressor with a pressure ratio of three per stage, the calculated power loss due to dump pockets 16 is less than one tenth of one percent of the adiabatic work of compression. The reasons for such an unexpectedly low power loss due to dump pockets are: (a) The calculated pressure at dumping is only about 3 PSIG, (b) The volume of the dump pockets is only 7% of the total displacement, and (c) the power or energy loss is that due to internal compression only as there is no loss due to delivery work since the 3 PSIG air is merely dumped back to inlet pressure and not delivered to a discharge line.

To calculate the energy loss due to dump pockets, proceed as follows: The work of internal compression only (no delivery) is $(P_2V_2-P_1V_1)/1-K$ from any text on thermodynamics. Use absolute pressures. Deduct the area below the atmospheric line as this is not a work item. Use 3 PSIG air pressure in the dump pocket at the instant of dumping the air out of the pocket. The volume of the 2 pockets 16 is only 7% of the total displacement.

When operating as an expansion engine, low pressure gas is dumped into the dump pockets 16 near the end of each expansion cycle. Timing gears are shown dotted at 35.

DESCRIPTION OF INTERCHAMBER THROTTLING LOSS IN PRIOR ART AS SHOWN IN FIG.4

Figure 4:
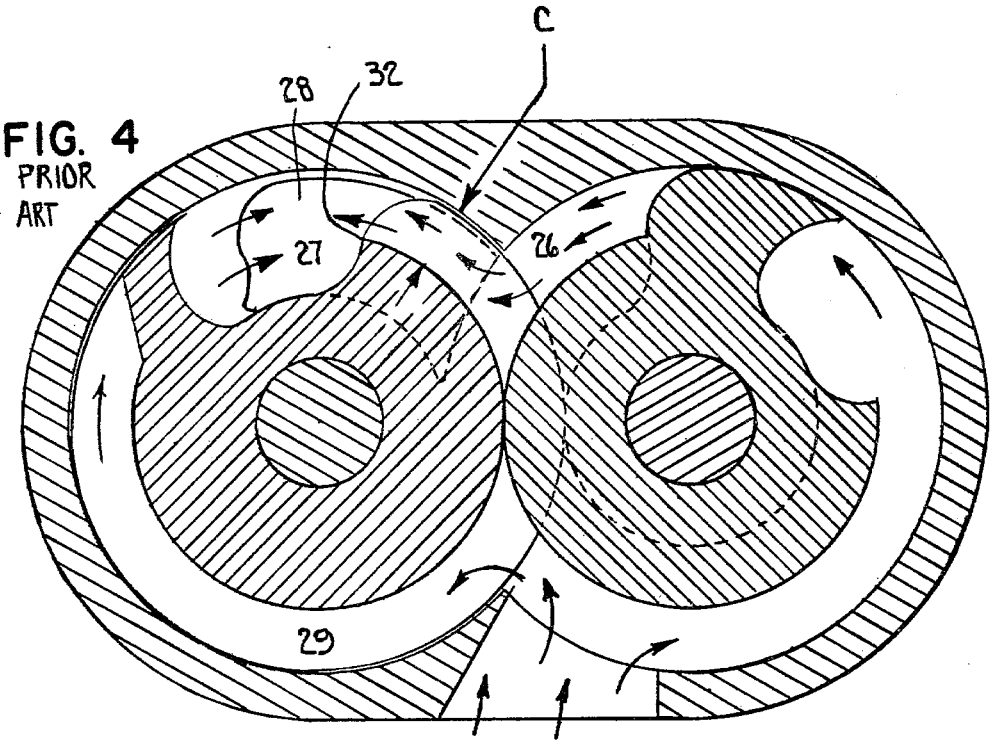
FIG. 4 PRIOR ART
FIG. 4 shows a prior art machine which has an interchamber throttling loss problem.
Figure 6:
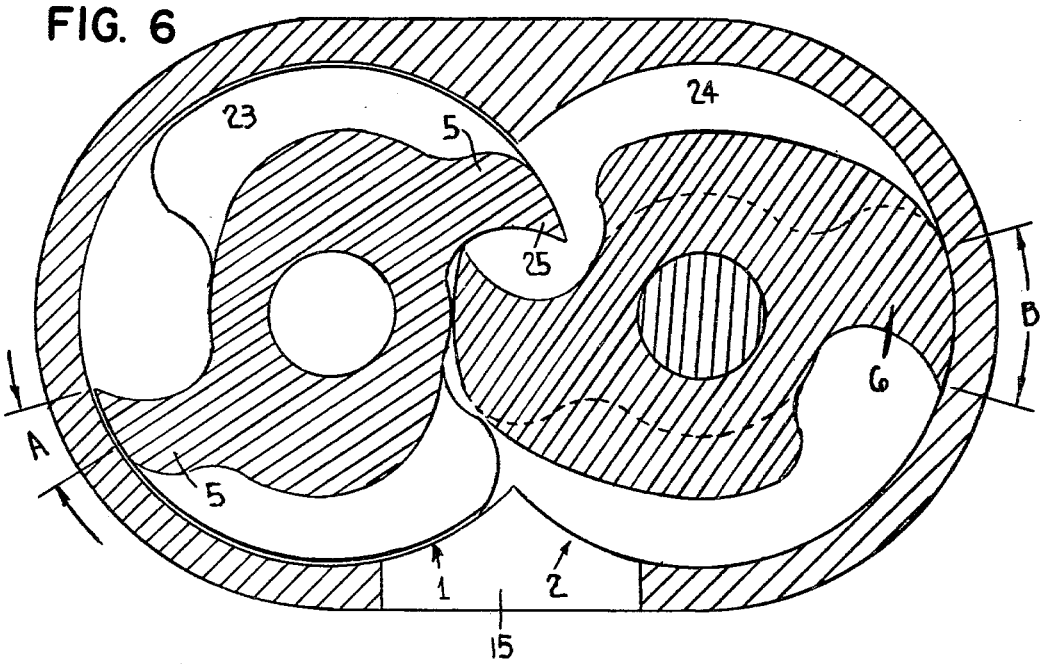
FIGS. 5 to 9 illustrate this invention in successive compressor-function rotative positions.

FIG. 4 illustrates rotors and casing as shown in my prior U.S. Pat. No. 3,535,060. All machines of this type are "leak machines" wherein internal leakage takes place but the object is to run at high RPM so that the leakage becomes a small percentage of total displacement. High RPM and high displacement means that it is necessary to avoid (as much as possible) those losses caused by the gas throttling through restriction. Such restrictions might be the inlet and outlet ports or it would be internal restrictions inside the machine.

One such internal restriction is shown at radial dimension and location "C" as shown in FIG. 4. When operating as a compressor machine, the air or gas must flow at high speed from chamber 26, past restriction C, into chamber 27, and then out through port 28. The throttling loss at restriction C is referred to as an "interchamber throttling loss" because it occurs due to flow between chamber 26 and 27. The flow passage at C is restricted (in FIG. 4—the prior art) because the air must flow between the two end plates 29 and the relatively small radial dimension C. In other words (in FIG. 4) the area of the flow passage at C is equal to the axial distance between the two end plates 29 multiplied by the radial dimension C. Thus the flow area at C (in FIG. 4) is diminished by the axial thickness of the two end plates 29. The end plates 29 cannot be made paper thin as they must resist bending due to back pressure through the ports 28. An object of this invention is to reduce such interchamber throttling loss.

REDUCING INTERCHAMBER THROTTLING LOSS

Figure 8:
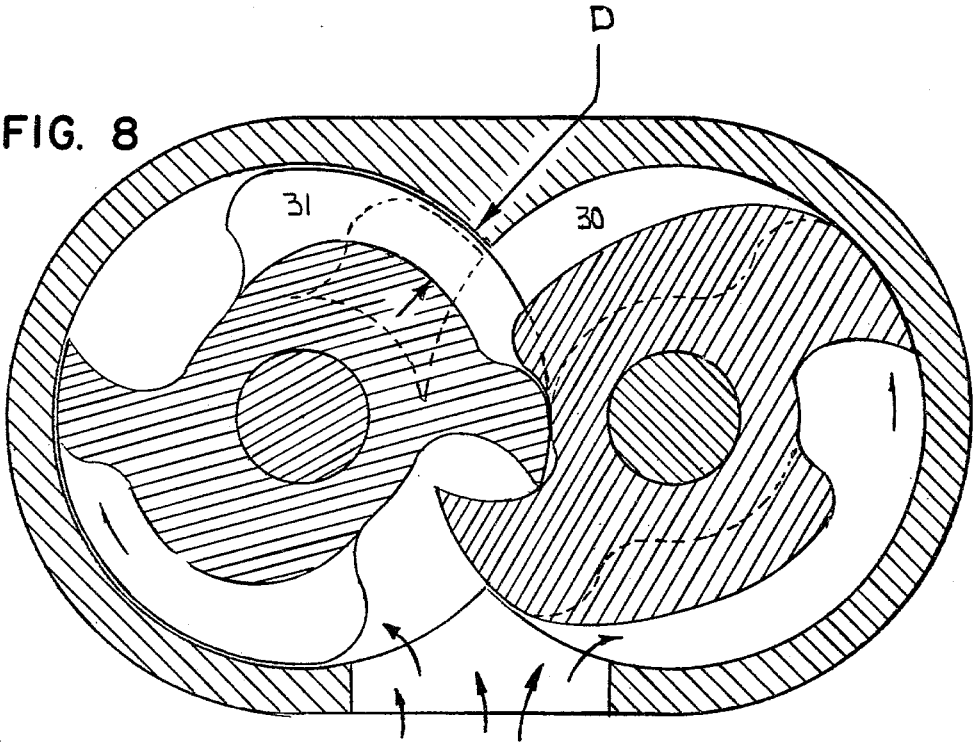

Assume operation as a compressor and refer to FIG. 8 which illustrates rotor positions during internal compression. At the FIG. 8 position, the two rotors are displacing and compressing air at nearly equal rates so that interchamber flow past dimension D is quite low and then there is no problem with throttling loss at D during this portion of the rotor cycle.

Figure 9:
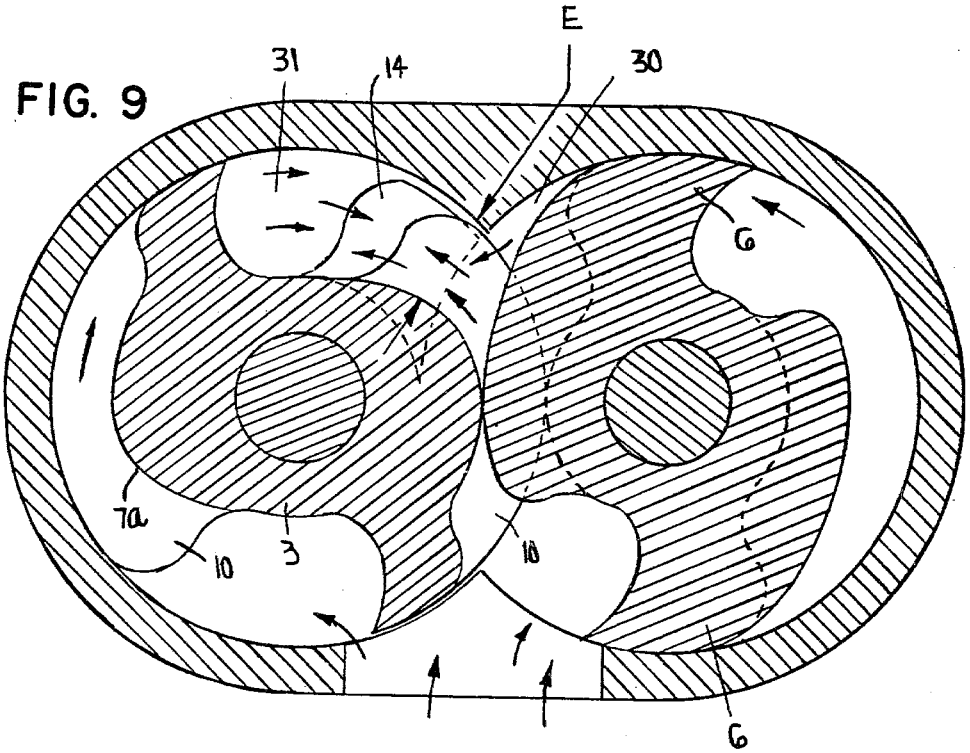

Assume operation still as a compressor and refer next to FIG. 9 which illustrates the rotor positions during a delivery portion of the rotor cycle. As can be seen in FIG. 9, the end plates 10 have partly uncovered the discharge ports 14 and air is flowing out of both chambers 30 and 31 through the discharge ports 14. At this rotor location, air must flow at high speed from chamber 30 past dimension "E" into chamber 31 and then through the ports 14. A particular feature of this invention is that the main rotor profiles are shaped such that dimension "E" is large so as to provide a large flow passage for the air past dimension E. The ports 14 are controlled by the end plates 10 so that it is possible to thus modify the main portions of the rotors without effecting the port timing.

It is particularly noted that dimension E of this invention (as shown in FIG. 9) substantially exceeds dimension C (as shown in FIG. 4 the prior art) and for this reason the flow area past E exceeds the flow area past C—so as to reduce interchamber throttling loss.

The prior art in FIG. 4 shows a sharp corner 32. That corner has now been removed and replaced with a convex rounded transition section *7a* in this invention FIG. 9. As a result of such rounding *7a*, the rotor hub 3 now has a general oval shape.

The use of two lobes per rotor (instead of single lobe rotors) also reduces interchamber loss.

Referring to FIG. 8, the volume of chamber 30 is less than that of chamber 31. In FIG. 9, the volume of chamber 30 is still less than that of chamber 31. This means that less volume must flow from chamber 30 past restriction E—thus interchamber throttling loss is further reduced. The volume of chamber 30 has now been reduced because of the oval hub 3 and fat lobes 6.

EARLY PORT OPENING—AS A COMPRESSOR

A feature of this invention is that performance (as a compressor machine) is improved by starting to uncover the higher pressure (discharge) ports 14 prior to the time when internal pressure (in chamber 31) reaches full discharge line pressure—Gas flow events cannot start instantaneously and such early port opening might be compared (in a very general way) to advancing the spark in an internal combustion engine.

The concept of early port opening has been tested with hardware in 50 horse power rotary compressor machines operating two stage at discharge pressures of 100 PSIG. Such testing was not done with rotors with end plates but with plain rotors as shown in the copending application.

Figure 14:
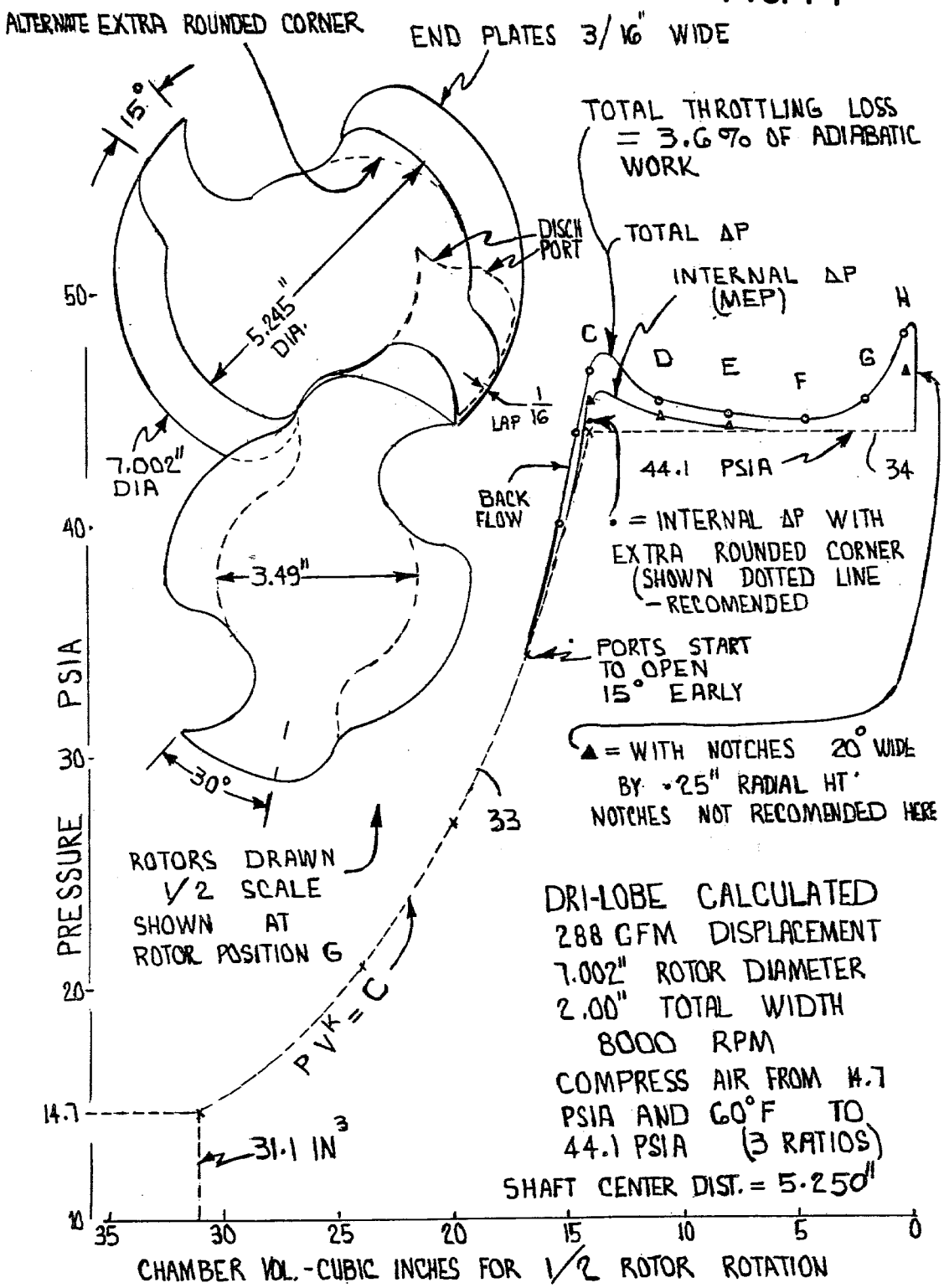
FIG. 14 is a calculated pressure/volume curve of a rotary compressor showing the results of early port opening. The profiles of the rotors calculated are shown on the same drawing.

Also, I have completed theoretical calculations on early port opening and sample results thereof are shown in FIG. 14.

Referring to FIG. 14, the dotted line 33 is an adiabatic compression curve and line 34 is discharge pressure. The ports 14 start to open 15 degrees early (before reaching line pressure) and some back flow occurs through the ports. The chamber pressure at ports c, d, e, f, g, and H exceed line pressure due to flow resistance through the ports 14. Without early port opening, the pressure at ports C, D, and E would go much higher.

The calculation procedure for FIG. 14 was as follows:

1. Cardboard rotors to scale were rotatably mounted on a cardboard work sheet simulating the casing with ports and bores.
2. The cardboard rotors were successively positioned at various rotative locations.
3. At each rotative location, port areas, pressures, and displacement rates were calculated.
4. The throttling loss at each location was calculated according to the formula:

$$\Delta p = (W/AK)^2/0.445\,\rho$$

where $\Delta p$ = pressure drop (throttling loss) across port or other restriction—P.S.I.

W = Instant displacement of flow rate—LBS per SEC

A = Area (square inches) of port or other restriction

K = Flow coefficient for the restriction = approx. 0.8 for most cases involved here.

$\rho$ = Upstream air density (LBS. per cubic foot).

The above formula was re-arranged from the A.S.M.E. power test code formula.

While I have shown and described my invention in connection with specific embodiments thereof, it is to be understood that this is done only by way of example, and not as a limitation of the scope of my invention as set forth in the appended claims.

I claim:

1. A rotary positive displacement machine adapted to handle a working fluid comprising: a casing structure having two intersecting bores, a first rotor mounted for rotation in one of said bores; a second rotor mounted for rotation in the other said bore; each rotor having both a main cross section profile and an end cross section profile; each main cross section profile being taken perpendicular to the axis of rotation of the rotor and midway along the axial width of the rotor; each end cross section profile being taken perpendicular to the axis of rotation of the rotor and near the axial end of the rotor; the main cross section profile of the first rotor having a main hub and two main lobes projecting radially outward therefrom; each main lobe of the first rotor having a concave face and a convex face; the main cross section profile of the second rotor having a main hub and two main lobes projecting radially outward therefrom and each main lobe having a concave face and a convex face; said main hub of the second rotor having two main grooves therein and each main groove being located angularly adjacent the concave face of a respective lobe; timing gears constraining said two rotors to rotate in timed relation; said main lobes on the first rotor being adapted to interengage with said main grooves in the main hub of the second rotor as the rotors rotate; said main hub of the second rotor being profiled so as to rotate in sealing relation with said main hub of the first rotor during portions of each rotation of the rotors; said end cross section profile of the first rotor being defined by a flat end plate with two grooves therein; the outermost radius of said end plate being larger than an outermost radius of the main hub of the first rotor; said end cross section profile of the second rotor having a smaller diameter hub with two end lobes projecting radially outward therefrom; each said end lobe being adapted to interengage with a said groove in the end plate as the rotors rotate; said smaller diameter hub being profiled so as to rotate in sealing relation with the outermost radius of said end plate during portions of each rotation of the rotors; said casing structure having a lower pressure port for passage therethrough of the working fluid at lower pressure; said casing structure also having a higher pressure port for passage therethrough of the working fluid at higher pressure; said higher pressure port being located in an end wall of the bore containing said first rotor; said end plate and its grooves therein serving to alternately cover and uncover said higher pressure port so as to control the flow of the working fluid through the higher pressure port; said higher pressure port having an outer radius which is larger than the outermost radius of said main hub of the first rotor; the said outer radius of the higher pressure port being measured from the axis of rotation of the first rotor; said first rotor and said bore containing the first rotor forming a first chamber; said second rotor and said bore containing the second rotor forming a second chamber; each rotor being adapted to displace the working fluid within its respective said chamber as the rotors rotate and wherein the improvement is comprised by said main hub of said first rotor having given radius profiles, at angular locations thereon which are adjacent to said concave faces of said main lobes of said first rotor, and other radius profiles which are larger than said given radius profiles at angular locations thereon which are adjacent to said convex faces of said main lobes of said first rotor, to reduce an interchamber throttling loss, during flow of the working fluid between said two chambers; and said first rotor hub further has rounded convex transition sections which interconnect said given radius profiles with said other larger radius profiles.

2. A rotary positive displacement machine, according to claim 1, wherein the first rotor main hub has a profile of a generally oval shape.

3. A rotary positive displacement machine according to claim 1, wherein said rounded convex transition sections have radii larger than one fifth of the outermost radius of said first rotor.

4. A rotary positive displacement machine, according to claim 1, wherein each of said main lobes has profiles which are concave on one face thereof and partly convex on the other face thereof; said rotors and casing structure define and bound dump pockets, and comprise means which momentarily form an aforesaid dump pocket twice per rotation of the first rotor; the casing structure has flat end walls at each end of the two said bores; each said dump pocket is bounded by said concave faces of two rotor lobes and said flat end walls of the casing structure; each of said dump pockets conducts relatively low pressure working fluid back to inlet pressure when operating as a compressor machine; and each said dump pocket has relatively low pressure working fluid conducted thereinto when operating as an expansion engine.

5. A rotary positive displacement machine, according to claim 1, wherein said main lobes of the first rotor occupy a given included angle, and said main lobes of the second rotor occupy another included angle which is greater than said given angle (a) to reduce a precompression loss (when operating as a compressor), (b) to reduce an expansion loss (when operating as an expansion engine), (c) to reduce a throttling loss of the working fluid as it passes through said higher pressure port near the end of each delivery phase (when operating as a compressor), and (d) to reduce a throttling loss of the working fluid as it passes through said higher pressure port near the start of admission (when operating as an expansion engine).

* * * * *